US005969684A

United States Patent [19]

Oh et al.

[11] Patent Number: 5,969,684

[45] Date of Patent: Oct. 19, 1999

[54] CAPACITIVE COUPLED EXTENDABLE ANTENNA FOR PORTABLE COMMUNICATION DEVICES

[75] Inventors: Jung Kun Oh, Ansan-Si; Kyung Min Lee, Sihung-Si; Duk Jae Park, Incheon; Choong Ki Cho, Incheon; Jung Mi Park, Incheon, all of Rep. of Korea

[73] Assignee: ACE Technology Co., Ltd., Kyunggi, Rep. of Korea

[21] Appl. No.: 09/078,101

[22] Filed: May 13, 1998

[51] Int. Cl.[6] ..... H01Q 1/24

[52] U.S. Cl. ..... 343/702; 343/895; 343/901

[58] Field of Search ..... 343/702, 895, 343/901; H01Q 1/24

[56] References Cited

U.S. PATENT DOCUMENTS

| | | | |
|---|---|---|---|
| 4,121,218 | 10/1978 | Irwin et al. . | |
| 4,137,534 | 1/1979 | Goodnight | 343/752 |
| 4,868,576 | 9/1989 | Johnson, Jr. . | |
| 5,317,325 | 5/1994 | Bottomley . | |
| 5,389,938 | 2/1995 | Harrison . | |
| 5,438,339 | 8/1995 | Itoh et al. . | |
| 5,446,469 | 8/1995 | Makino . | |
| 5,455,595 | 10/1995 | Yokoyama et al. . | |
| 5,467,096 | 11/1995 | Takamoro et al. . | |
| 5,479,178 | 12/1995 | Ha . | |
| 5,504,494 | 4/1996 | Chatzipetros et al. . | |
| 5,521,605 | 5/1996 | Koike . | |
| 5,594,457 | 1/1997 | Wingo . | |
| 5,612,704 | 3/1997 | Cole . | |
| 5,635,943 | 6/1997 | Grunwell . | |
| 5,650,789 | 7/1997 | Elliott et al. . | |
| 5,661,496 | 8/1997 | Baek et al. . | |
| 5,670,968 | 9/1997 | Inanaga et al. . | |
| 5,686,927 | 11/1997 | Simmons . | |
| 5,717,408 | 2/1998 | Sullivan et al. . | |
| 5,825,330 | 10/1998 | Na et al. | 343/702 |

*Primary Examiner*—Don Wong
*Assistant Examiner*—Jennifer H. Malos
*Attorney, Agent, or Firm*—Yong Hyon Cho

[57] ABSTRACT

A capacitive coupled extendable antenna for portable radio communication devices with improved operating characteristics is disclosed. The extendable antenna includes a quarter-wavelength helical antenna, a quarter-wavelength whip antenna movable between the extended position and the retracted position through the helical antenna, and an electrically conductive sleeve acting as the feed point of the antenna. The helical antenna is electrically insulated from the sleeve so that the helical antenna is capacitively coupled to the sleeve. The whip antenna is enclosed within an insulating tube, which is disposed within a guide for longitudinal movement therethrough. The whip antenna is disposed in electrically insulated relation to the sleeve in the retracted position and electrically connected to the sleeve in the extended position via a stopper. When the whip antenna is in the extended position, the whip antenna is operative through direct coupling with the sleeve and when the whip antenna is in the retracted position, the helical antenna is operative through capacitive coupling with the sleeve. In a preferred embodiment, the whip antenna is short-circuited at the point of 90° in electrical phase so as to form a λ/4 balun. The resulting extendable antenna offers wider operating bandwidth and improved radiation efficiency when operating in the retracted or stand-by mode.

17 Claims, 3 Drawing Sheets

CAPACITIVE COUPLED EXTENDABLE ANTENNA FOR PORTABLE COMMUNICATION DEVICES

BACKGROUND OF THE INTENTION

1. Field of the Invention

The present invention relates generally to the field of antennas and more particularly to an extendable antenna for use with portable radio communication devices.

2. Description of the Prior Art

Extendable antennas are widely used for receiving and transmitting radio frequency signals in portable radio communication devices such as cordless telephones and cellular/PCS (Personal Communication Service) telephones. Generally, such extendable antennas operate in an extended position when the telephone is in the "talking" or "transmit and receive" mode, but must remain functional in a retracted position to allow the telephone to receive an incoming call while in the "stand-by" or "receive only" mode. The extendable antennas are typically implemented in a dual-antenna configuration, as shown in FIG. 1A and 1B, where a quarter-wavelength helical antenna element 12 and a quarter-wavelength whip antenna element 14 are separated from each other at an interval such that the whip antenna element 14 is operational when the antenna 10 is in the extended position while the helical antenna element 12 is operational when the antenna 10 is in the retracted position. The whip antenna element 14 and the helical antenna element 12 do not affect performance and operate independent of each other, with the whip antenna element 14 being active during the transmit and receive mode of operation and the helical antenna element 12 being operative for receiving the incoming signals during the stand-by mode of operation.

However, since such conventional antennas are operated in the retracted position only by an inherently less efficient quarter-wavelength helical antenna, they generally suffer from narrow operating bandwidth and low radiation efficiency in the retracted or stand-by mode of operation. Accordingly, the present invention aims to provide a capacitive coupled extendable antenna which is capable of operating with wider operating bandwidth and improved radiation efficiency while achieving more stabilized operating characteristics and mechanical reliability.

SUMMARY OF THE INVENTION

The present invention overcomes the preceding and other shortcomings of the prior art by providing an improved capacitive coupled extendable antenna comprising feeding means connected to the radio frequency circuit within a housing, quarter-wavelength helical antenna means disposed in electrically insulated relation with the feeding means for providing capacitive coupling therebetween, and quarter-wavelength whip antenna means movable between an extended position and an retracted position through the helical antenna means. The whip antenna means is directly coupled to the feeding means in the extended position and capacitively coupled to the feeding means in the retracted position. The whip antenna means in the retracted position is short-circuited at a point of 90° in electrical phase so as to form a $\lambda/4$ balun. In the preferred embodiment, the whip antenna means is enclosed within an insulator tube and adapted for longitudinal movement between the extended position and the retracted position through the cylindrical guide provided in the housing. The insulator tube provides capacitive coupling between the whip antenna means and the feeding means when the whip antenna means is in the retracted position. A stopper connected to the lower end of the whip antenna means prevents the whip antenna means from being fully removed from the housing and provides direct coupling between the whip antenna means and the feeding means when the whip antenna means is pulled out of the housing to the extended position.

With such an arrangement, the whip antenna means is operative through direct coupling with the feeding means when the whip antenna means is in the extended position and the helical antenna means is operative through capacitive coupling with the feeding means when the whip antenna means is in the retracted position. This capacitive coupling between the feeding means and the helical antenna means operates to compensate for the inherently deficient capacity component of the helical antenna means, thereby improving its operating characteristics. The performance of the helical antenna means is also stabilized since the whip antenna means in the retracted position forms a $\lambda/4$ balun. The resulting extendable antenna provides wider operating bandwidth, improved radiation efficiency, and more stabilized operating characteristics in the retracted mode of operation. Additionally, the present extendable antenna is simple in structure and mechanically reliable.

BRIEF DESCRIPTION OF THE DRAWINGS

These and other features and advantages of this invention will become further apparent from the detailed description and accompanying drawing figures that follow. In the figures and description, numerals indicate the various features of the invention, like numerals referring to like features throughout both the drawings and the description.

DETAILED DESCRIPTION OF THE PREFERRED EMBODIMENTS

Figure 2:
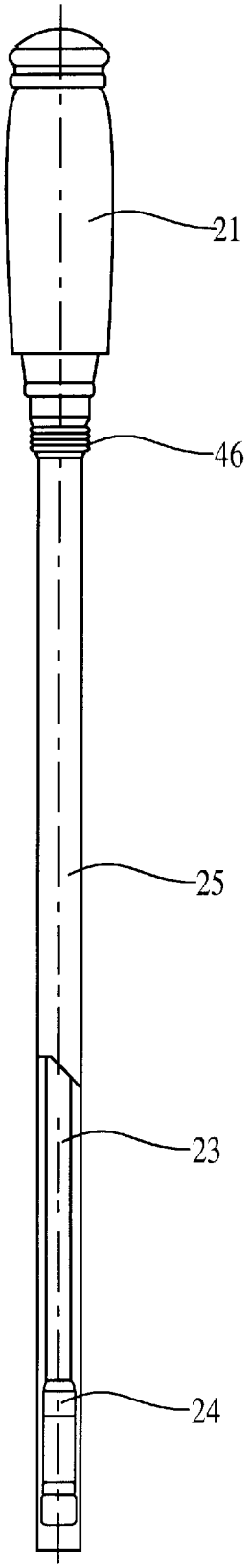
FIG. 2 is a partially cut-away elevational view of an extendable antenna according to the present invention, shown in the retracted position.
Figure 3:
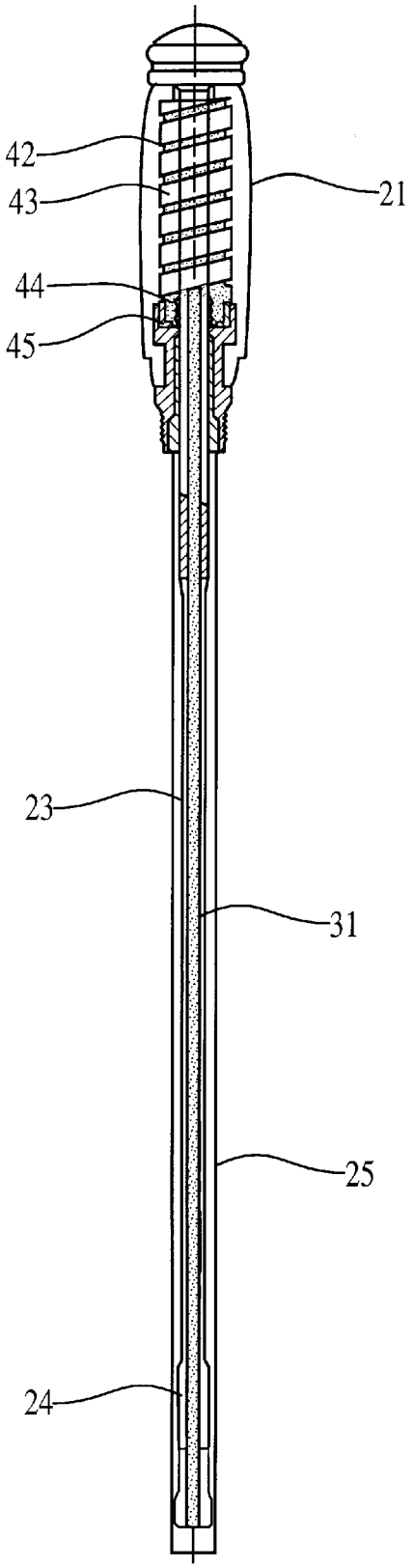
FIG. 3 is a cross-sectional view of the extendable antenna according to the present invention, shown in the retracted position.

Referring now to FIGS. 2 and 3, the extendable antenna of the present invention includes a helical antenna 21, a whip antenna 31 enclosed within a cylindrical insulator tube 23, and an elongated cylindrical guide 25 having an upper end portion inserted within the helical antenna 21 for fixed engagement therewith. Within the interior of the guide 25, the insulator tube 23 is disposed for longitudinal movement between the extended position and the retracted position. A stopper 24 is provided at the lower end of the insulator tube 23 and connected to the lower end of the whip antenna 31. The whip antenna 31 is preferably made of highly elastic nickel-titanium alloy to improve the restorability and the mechanical reliability of the antenna. In the preferred embodiment, both the helical antenna 21 and the whip antenna 31 have an electrical length of substantially a quarter-wavelength.

Figure 1A:
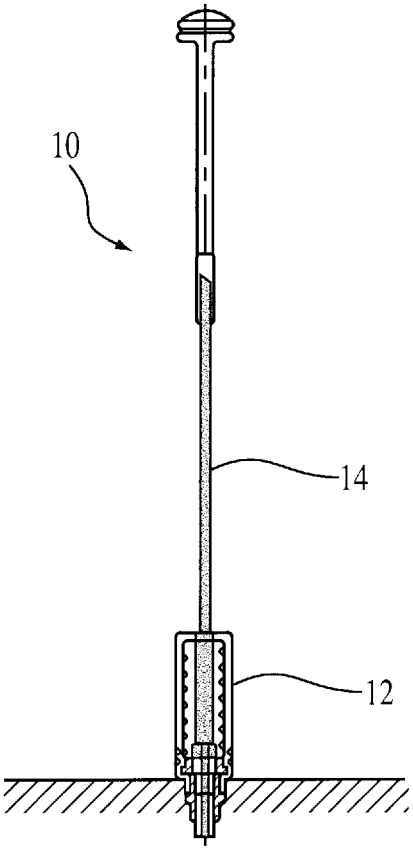
FIGS. 1A and 1B are simplified views of a prior art extendable antenna shown in the extended position and in the retracted position, respectively.
Figure 1B:
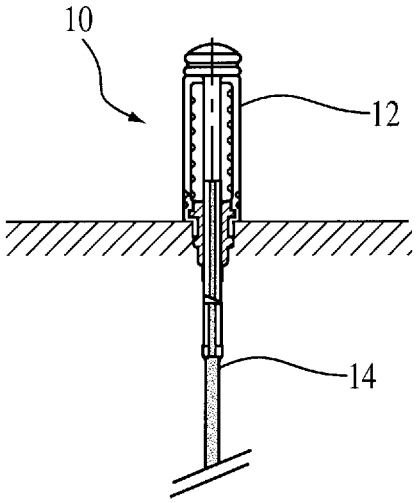
Figure 4:
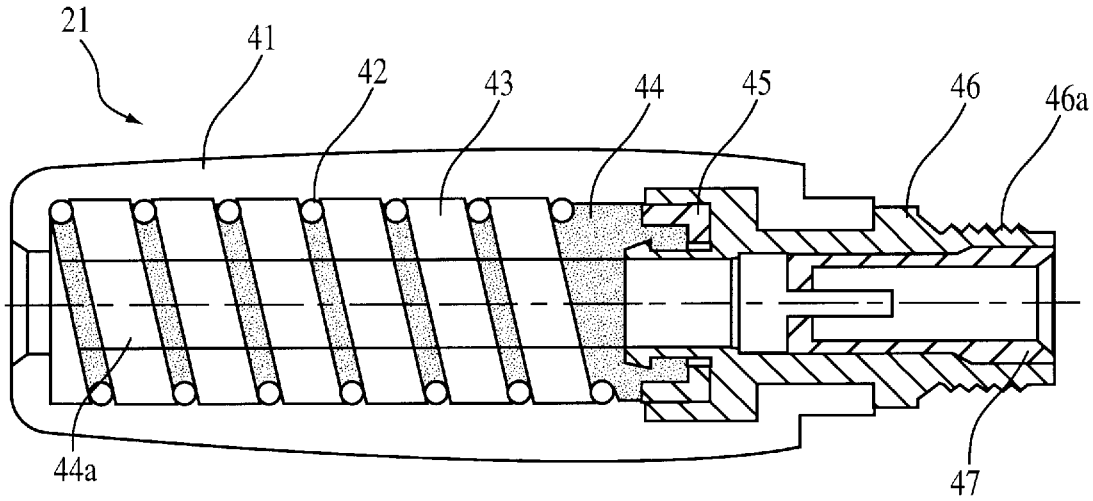
FIG. 4 is an enlarged cross-sectional view showing details of the extendable antenna in FIG. 3.

Now referring to FIGS. 3 and 4, the helical antenna 21 includes a cover 41 having a hollow interior portion and an opening at both ends. At one end of the cover 41, a metallic sleeve 46 is partially inserted along a portion of the interior of the cover 41 for fixed engagement therewith. The sleeve 46 is adapted to act as a feed point of the antenna and has an outer-threaded portion 46*a* for fixedly mounting the sleeve 46 onto the separate telephone housing (not shown) . A plate spring 47 installed on the inner periphery of the sleeve 46 restraints the stopper 24 from further outward movement when the extendable antenna is pulled out of the telephone housing to the extended position, thereby preventing the whip antenna 31 from being fully removed through the helical antenna 21.

The helical antenna 21 further includes a helical coil 42 wound about a first insulator 43 at a predetermined coiling interval along the helical recess formed on the outer surface thereof. The first insulator 43 is attached at its lower end to a metallic base 44, which is connected to one end of the helical coil 42 for electrical coupling. The metallic base 44 is electrically insulated from the sleeve 46 by a second insulator 45 fixedly installed within the upper end portion of the sleeve 46. The first insulator 43 and the metallic base 44 are disposed centrally within the interior of the cover 41 and axially aligned with the sleeve 46, forming a longitudinally thorough hole 44*a* through which the whip antenna 31 is extended outward from and retracted inward into the telephone housing.

Figure 5A:
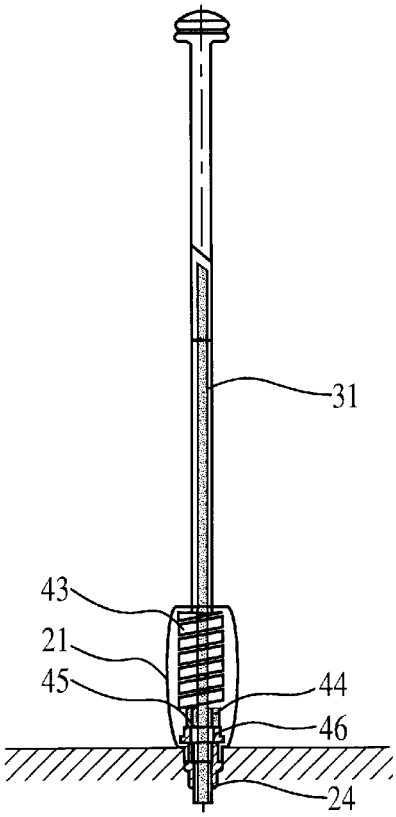
FIGS. 5A and 5B are simplified views of the extendable antenna according to the present invention, shown in the extended position and in the retracted position, respectively.
Figure 5B:
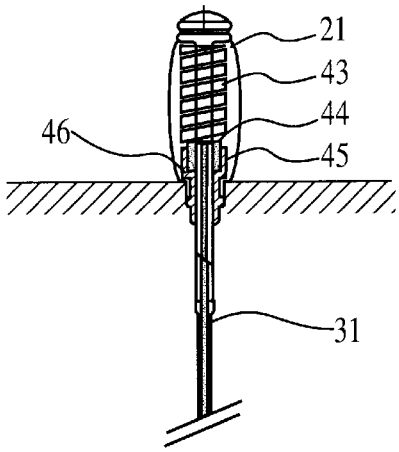
Figure 6A:
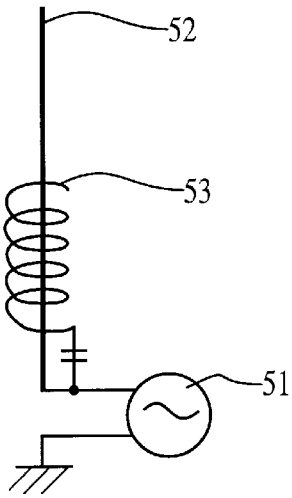
FIGS. 6A and 6B are simplified equivalent circuit diagrams of the extendable antenna according to the present invention, shown in the extended position and in the retracted position, respectively.
Figure 6B:
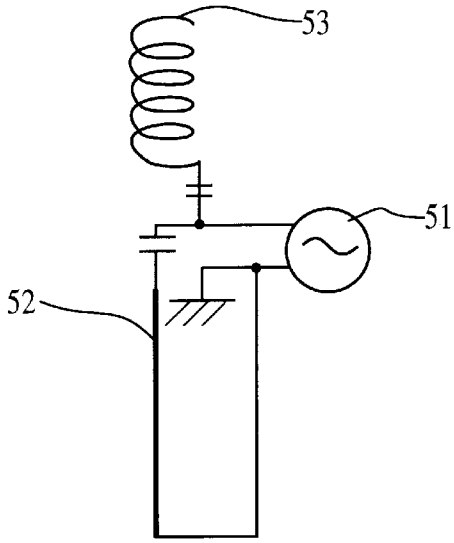

FIGS. 5A and 5B show the extendable antenna of the present invention in the extended position and in the retracted position, respectively. FIGS. 6A and 6B are simplified equivalent circuits of the respective antenna arrangements of FIGS. 5A and 5B. Now referring to FIG. 5A, when the whip antenna 31 is fully extended from the telephone housing, the stopper 24 makes contact with the sleeve 46 and the junction therebetween becomes the feed point of the antenna. As a result, the whip antenna 31 in the extended position becomes operative for transmitting and receiving radio frequency signals. At the same time, since the metallic base 44 is capacitively coupled to the sleeve 46 by means of the second insulator 45, the helical antenna 21 is capacitively coupled to the whip antenna 31 in parallel with respect to the feed point of the antenna. Thus, in terms of the equivalent circuit as shown in FIG. 6A, the whip antenna 52 and the helical antenna 53 are coupled in parallel to the feed point 51 of the antenna.

On the other hand, when the whip antenna 31 is retracted into the telephone housing as shown in FIG. 5*b*, the whip antenna 31 is capacitively coupled to the sleeve 46 by means of the insulator tube 23, and the helical antenna 21 becomes operative through capacitive coupling between the sleeve 46 and the metallic base 44. With such an arrangement, the capacitive coupling between the sleeve 46 and the metallic base 44 operates to compensate for the deficient capacity component of the helical antenna 21 so that, the operational bandwidth of the present antenna in the retracted position becomes wider than that of the prior art extendable antenna. In addition, such capacitive coupling arrangement improves the radiation efficiency of the antenna in the retracted mode of operation. Furthermore, the operating characteristics of the present antenna in the retracted position can be made more stable than that of the prior art extendable antenna by making the capacitive coupled whip antenna 31 short-circuited at a point of 90° in electrical phase so as to form a $\lambda/4$ balun. The $\lambda/4$ balun can be formed by providing a $\lambda/4$ stripline within the telephone housing. The $\lambda/4$ stripline is connected at one end to the sleeve 46 and is adapted to make contact with the stopper 24 at the other end when the whip antenna 31 is fully retracted into the housing. Thus, in terms of the equivalent circuit as shown in FIG. 6B, the present antenna in the retracted position operates only with the helical antenna 53 via the feed point 51 while the whip antenna 52 forms a $\lambda/4$ balun through the capacitive coupling with the sleeve 46.

From the foregoing it should be evident that there has been described a new and advantageous extendable antenna utilizing capacitive coupling method. In particular, the present extendable antenna operates over a wider operating bandwidth with improved radiation efficiency in the retracted mode of operation. The present extendable antenna is simple in structure and mechanically reliable, and exhibits more stabilized operating characteristics.

While this invention has been described with reference to its presently preferred embodiments, its scope is not limited thereto. The present invention can be implemented in various additional configurations and by utilizing other materials, mediums, devices, or structures exhibiting similarly desirable characteristics or traits. In particular, the electrical lengths of the helical and whip antennas in the present antenna are not limited to a quarter-wavelength, but may also be an integral multiple of that. The elements typically constructed of electrically conductive material may be fabricated with an insulator material coated with an electrically conductive material. The size, shape or location of the antenna elements, coupling means, and support structures may be varied, depending upon the particular operating frequency or the amount of coupling desired for a particular application.

It will now be apparent to one skilled in the art that many and other various changes and modifications may be made without departing from the spirit and scope of the invention. It is intended, therefore, that all those changes and modifications as fairly fall within the scope of the appended claims be considered as part of the present invention. The scope of the invention is only limited insofar as defined by the following set of claims and all equivalents thereof.

What is claimed is:

1. An extendable antenna for a radio frequency circuit enclosed in a housing, comprising:

feeding means connected to said radio frequency circuit;

helical antenna means having a predetermined electrical length and capacitively coupled to said feeding means; and whip antenna means having a predetermined electrical length and movable between an extended position and a retracted position through said helical antenna means, said whip antenna means being directly coupled to said feeding means in said extended position and being capacitively coupled to said feeding means in said retracted position;

wherein said whip antenna means is operative through said direct coupling with said feeding means when said whip antenna means is in said extended position and said helical antenna means to is operative through said capacitive coupling with said feeding means when said whip antenna means is in said retracted position.

2. The extendable antenna according to claim 1, wherein said electrical length of said helical antenna means is substantially a quarter of the wavelength at a desired frequency of operation.

3. The extendable antenna according to claim 2, wherein said electrical length of said whip antenna means is substantially a quarter of the wavelength at said frequency of operation.

4. The extendable antenna according to claim 3, wherein said whip antenna means in said retracted position is short-circuited at a point of 90° in electrical phase so as to form a λ/4 balun, where λ is the wavelength at said frequency of operation.

5. The extendable antenna according to claim 1, wherein said feeding means is attached to a lower portion of said helical antenna means in electrically insulated relation.

6. The extendable antenna according to claim 5, wherein said feeding means is adapted to be mounted onto said housing.

7. The extendable antenna according to claim 6, further including:

guiding means fixedly disposed within said housing;

insulating means enclosing said whip antenna means and longitudinally movable between said extended position and said retracted position through said helical means, said insulating means providing said capacitive coupling between said whip antenna means and said feeding means when said whip antenna means is in said retracted position; and stopping means connected to the lower end of said whip antenna means, said stopping means operating to prevent said whip antenna means from being fully removed from said housing and to provide said direct coupling between said whip antenna means and said feeding means when said whip antenna means is in said extended position.

8. The extendable antenna according to claim 7, wherein said electrical length of said helical antenna means is substantially a quarter of the wavelength at a desired frequency of operation.

9. The extendable antenna according to claim 8, wherein said electrical length of said whip antenna means is substantially a quarter of the wavelength at said frequency of operation.

10. The extendable antenna according to claim 9, wherein said whip antenna means in said retracted position is short-circuited at a point of 90° in electrical phase so as to form a λ/4 balun, where λ is the wavelength at said frequency of operation.

11. The extendable antenna according to claim 10, further including a λ/4 stripline disposed within said housing, said λ/4 stripline connecting said feeding means to said stopping means so as to form said λ/4 balun when said whip antenna means is in said retracted position.

12. An extendable antenna for a radio frequency circuit enclosed in a housing, comprising:

an electrically conductive sleeve connected to said radio frequency circuit;

a helical antenna including a cover fixedly engaged with said sleeve, a helical winding disposed within said cover, a metallic base attached to one end of said helical winding, and an insulator interposed between said metallic base and said sleeve for providing capacitive coupling therebetween;

a guide fixedly disposed within said housing;

an insulating tube disposed within said guide for longitudinal movement therethrough;

a whip antenna enclosed within said insulating tube and extendable between an extended position and an retracted position through said helical antenna, said whip antenna being capacitively coupled to said sleeve by means of said insulating tube when said whip antenna is in said retracted position; and a stopper connected to the lower end of said whip antenna means, said stopper operating to prevent said whip antenna from being fully removed from said housing and to provide direct coupling between said whip antenna and said sleeve when said whip antenna is in said extended position;

wherein said whip antenna is operative through said direct coupling with said sleeve when said whip antenna is in said extended position and said helical antenna is operative through said capacitive coupling with said sleeve when said whip antenna is in said retracted position.

13. The extendable antenna according to claim 12, wherein the electrical length of said helical antenna is substantially a quarter of the waveLength at a desired frequency of operation.

14. The extendable antenna according to claim 13, wherein the electrical length of said whip antenna is substantially a quarter of the wavelength at said frequency of operation.

15. The extendable antenna according to claim 14, wherein said whip antenna in said retracted position is short-circuited at a point of 90° in electrical phase so as to form a λ/4 balun, where λ is the wavelength at said frequency of operation.

16. The extendable antenna according to claim 15, further including a λ/4 stripline disposed within said housing, said λ/4 stripline connecting said sleeve to said stopper so as to form said λ/4 balun when said whip antenna is in said retracted position.

17. The extendable antenna according to claim 16, wherein said sleeve is adapted to be mounted onto said housing.

* * * * *